US010317071B2

(12) United States Patent
Kodak

(10) Patent No.: US 10,317,071 B2
(45) Date of Patent: Jun. 11, 2019

(54) THERMAL RESERVOIR FOR A STEAM ENGINE

(71) Applicant: James Allen Kodak, Odenton, MD (US)

(72) Inventor: James Allen Kodak, Odenton, MD (US)

( * ) Notice: Subject to any disclaimer, the term of this patent is extended or adjusted under 35 U.S.C. 154(b) by 343 days.

(21) Appl. No.: 15/364,246

(22) Filed: Nov. 29, 2016

(65) Prior Publication Data

US 2018/0149352 A1 May 31, 2018

(51) Int. Cl.
*F01K 3/26* (2006.01)
*F22B 1/28* (2006.01)

(52) U.S. Cl.
CPC ..... *F22B 1/284* (2013.01); *F01K 3/262* (2013.01)

(58) Field of Classification Search
CPC .. F22B 1/284; F22B 1/04; F01K 3/262; F24F 5/0017; F24F 5/0021; F24F 2005/0025; F24F 2005/0028; F28D 20/00; F28D 20/0052; F28D 20/0056; F28D 17/005; F28D 17/00; F27D 1/00; F27D 17/004; F27D 17/00
USPC .... 392/405; 165/236, 902, DIG. 9, DIG. 42; 432/29, 30, 214, 216, 217, 218; 219/430, 219/439, 540
See application file for complete search history.

(56) References Cited

U.S. PATENT DOCUMENTS 3,596,034 A * 7/1971 Mekjean ..... F24H 7/0433 165/10
3,823,305 A * 7/1974 Schroder ..... F24H 7/0416 126/400
3,855,795 A * 12/1974 Noble ..... F02G 1/043 165/104.21
5,694,515 A * 12/1997 Goswami ..... F24H 7/0433 137/341
7,933,506 B2 * 4/2011 Kodak ..... F01K 3/00 392/441
2007/0023163 A1 * 2/2007 Kidwell ..... F25B 30/06 165/45
2007/0209365 A1 * 9/2007 Hamer ..... C09K 5/00 60/648
2008/0289793 A1 * 11/2008 Geiken ..... F28D 20/00 165/10
2009/0175603 A1 * 7/2009 Gode ..... F24D 11/002 392/346
2011/0017196 A1 * 1/2011 Bell ..... F24D 11/003 126/400
2012/0085093 A1 * 4/2012 Kim ..... F24F 5/0046 60/641.8

* cited by examiner

*Primary Examiner* — Justin M Jonaitis

(57) ABSTRACT

A thermal reservoir for storing heat energy that can convert water to steam and thus power steam driven machines and vehicles is enclosed. The thermal reservoir converts electrical energy to heat energy using electrical resistance heating coils and the heat energy is stored with a thermal storage substance consisting primarily of lithium fluoride. Heat loss is minimized with a specially designed insulation layer that surrounds the thermal storage compartment. The thermal reservoir is charged and discharged via a heat exchanging system comprised of nested cylinders and a plurality of heat conducting fins that innervate the thermal storage compartment.

15 Claims, 6 Drawing Sheets

THERMAL RESERVOIR FOR A STEAM ENGINE

BACKGROUND OF THE INVENTION

The internal combustion engine powering the vast majority of today's automobiles, power boats and lawn mowers has several drawbacks: the cost of fuel, the inconvenience of refueling, the depletion of a finite energy source, and the environmental impact of extracting, transporting, and burning billions of barrels of petroleum every year. There has thus been a long standing effort to develop alternative automotive energy sources. Utilizing electrical energy is the most obvious alternative, but this approach has required the use of batteries that possess their own significant drawbacks, such as: a much smaller energy density relative to gasoline, high cost of manufacture, long recharging times, short lifespans, and compromised performance in extreme temperatures. The enclosed invention depends on electricity as the ultimate source of energy but stores that energy in a fundamentally different way. Rather than relying on electrochemical batteries, the electrical energy is converted into and stored as thermal energy within an insulated reservoir. This thermal reservoir serves essentially as a replacement for the boiler in a steam driven vehicle. Without the boiler, there is no longer the need to vent combusted gas products and thus the greatest source of inefficiency in automotive steam engines is obviated. Furthermore, since the heat is already present within the thermal reservoir, there is no longer a need to ignite a lamp within a boiler and wait for steam pressure to build up; the steam can be generated almost instantly.

The thermal reservoir can be categorized as an encapsulated thermal battery. Encapsulated thermal battery technologies have mostly been directed towards regulating the operating temperature of specific components within various mechanical and electrical devices. The use of encapsulated heat as a means of energy storage has received far less attention and efforts in this regard have been generally limited to home heating or providing a means for power stations to store energy during non-peak hours. Examples of power station technology include: U.S. Pat. No. 4,146,057 that teaches the use of aluminum as a heat storage means when the primary source of energy is solar and the heat is to be later retrieved in the form of electricity; JP2000097498 teaches a heat battery employing magnesia, magnetite, silica and/or alumina as heat storage substances; and JP2007032866 teaches the importance of heat exchanger design, employing the use of fins emanating from the heat exchanger tube, when a heat battery is used for electricity generation.

Efforts at using encapsulated thermal batteries for powering vehicles have not yet been fully developed. U.S. Pat. No. 7,933,506 teaches the use of aluminum to serve as the primary thermal storage substance in the powering of vehicles. In conjunction with a robust insulating jacket, heat exchanger, and an automatic means of switching between the steam port and an insulation plug, this design offers significant energy storage potential. 500 kg of aluminum between the temperature range 150-800 C holds 549 MJ. This is the energy equivalent of 4.2 gallons of fully combusted gasoline. However, in order to achieve practical levels of stored thermal energy, the aluminum must be heated above it melting point of 657 C. In fact, 200 of the 549 MJ is attributable to aluminum's very substantial heat of fusion. Unfortunately, the combination of high temperature, high thermal conductivity, and liquid phase makes aluminum a significant hazard in the event of a collision. A robust containment means would have to be devised in order to prevent the spillage of molten aluminum.

SUMMARY OF THE INVENTION

The present invention is essentially an encapsulated thermal battery for energy storage. It is a thermal reservoir that can serve as a boiler for a steam engine. It converts electrical energy into heat which is then used to make steam that drives a piston or turbine engine. Electrical energy is applied to a heating element and the heat is stored within a reservoir containing lithium fluoride. To prevent loss of heat, the lithium fluoride is surrounded by a jacket with an extremely low thermal conductance. Water is injected into a heat exchanger innervating the reservoir and this converts the water to steam. This steam is then used to drive a piston or turbine engine. The residual steam can be either vented off or returned to a condenser for reuse.

Given the very high temperatures involved in using heat as an energy source, both the interior of the reservoir and the thermal jacket surrounding it must be essentially free of any gas that would otherwise lead to an extremely high interior pressure. Additionally, there must be a small vacuum chamber within the reservoir in order to accommodate the expansion of lithium fluoride during heating. Once the vehicle is no longer in operation, an automatic arm removes the steam conduit and replaces it with an insulation plug. The insulation plug is equipped with a pressure release valve that enables any residual air and steam to escape from the heat exchanger after the plug is put in place.

BRIEF DESCRIPTION OF THE DRAWINGS

An embodiment of the present invention will now be described by way of an example and with reference to the accompanying drawings, in which.

DETAILED DESCRIPTION OF THE INVENTION

Figure 1:
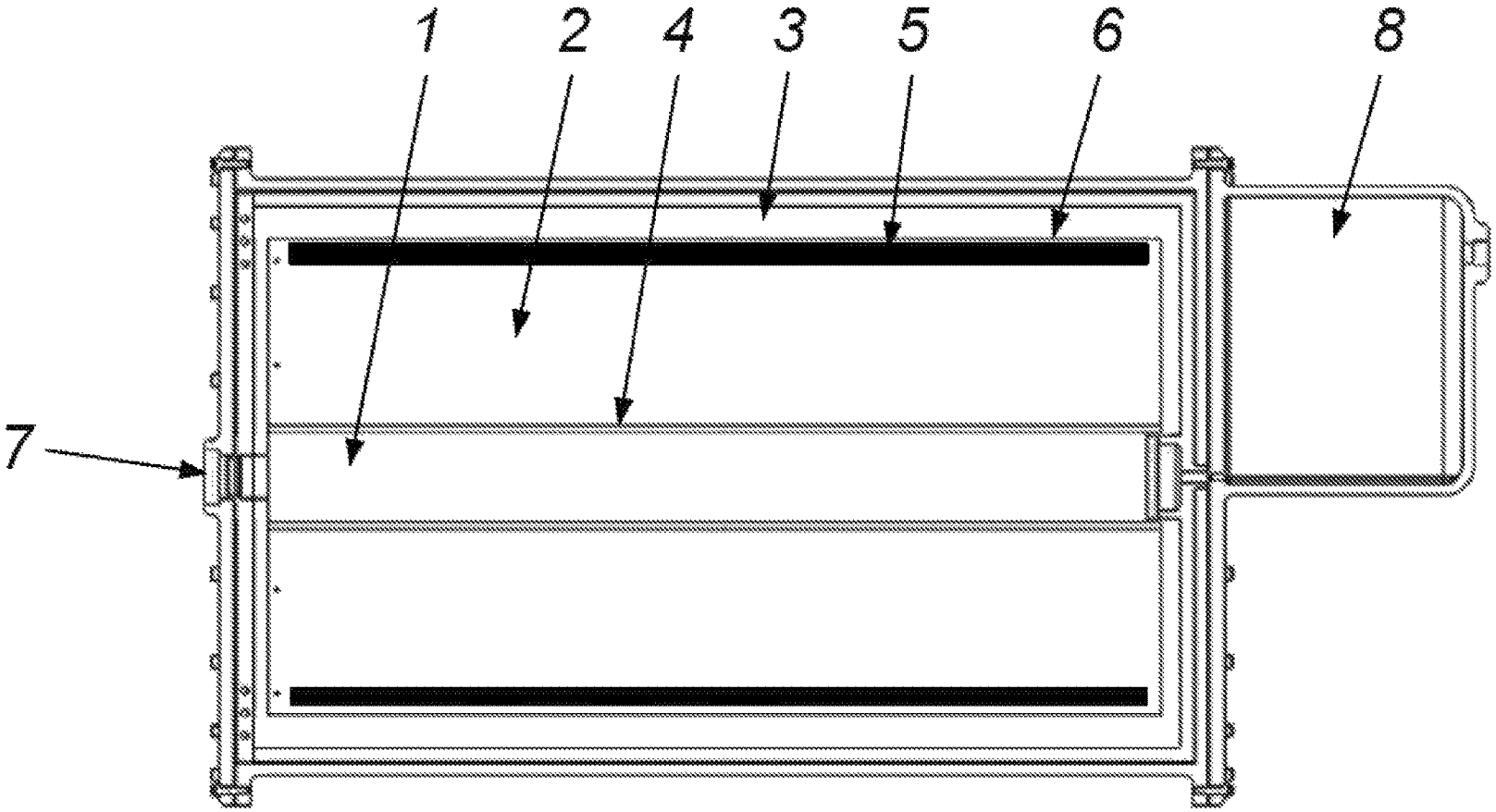
FIG. 1 illustrates a longitudinal sectional view of the thermal reservoir.

The preferred embodiment is a reservoir as shown in FIG. 1. The thermal reservoir possesses a cylindrical shape and houses three compartments: steam generation 1, thermal storage 2, and insulation 3. The steam generation compartment 1 is defined by the interior space of the steam cylinder 4. Outside the steam cylinder lies the thermal storage compartment 2. This compartment is filled a thermal storage substance and also possesses an evacuated space. An evacuated space is necessary to negate gas pressure and to accommodate the expansion of the thermal storage substance when heated. Outside the thermal storage compartment lies the insulation compartment 3. Heat is introduced to the reservoir via electrical heating elements 5 that attach to and run along the inner face of the charging cylinder 6.

The steam cylinder must be strong and possess a high melting point. The best material candidates are non-reactive, non-porous ceramics that maintains high thermal conductivity at elevated temperatures and are resistant to heat shock, e.g., silicon nitride or silicon carbide. Water is forcefully injected directly into the steam cylinder at one end and the steam escapes out the opposite end referred to as the steam port 7. A steady pressure is maintained during operation with a barostat controlled water injector. To assist in keeping the stored water supply in a liquid state during sub-freezing ambient temperatures, the water reservoir 8 should be kept close to the outer skin of the thermal reservoir. This enables the natural heat bleed of the thermal reservoir to flow directly into the water. The ideal embodiment places the water reservoir directly adjacent to the cylinder base that is on the side opposite of the steam port 7. The side of the water reservoir 8 immediately adjacent to the thermal reservoir should be thin and composed of good thermal conducting material. Whereas the remaining sides should be well insulated.

Figure 2:
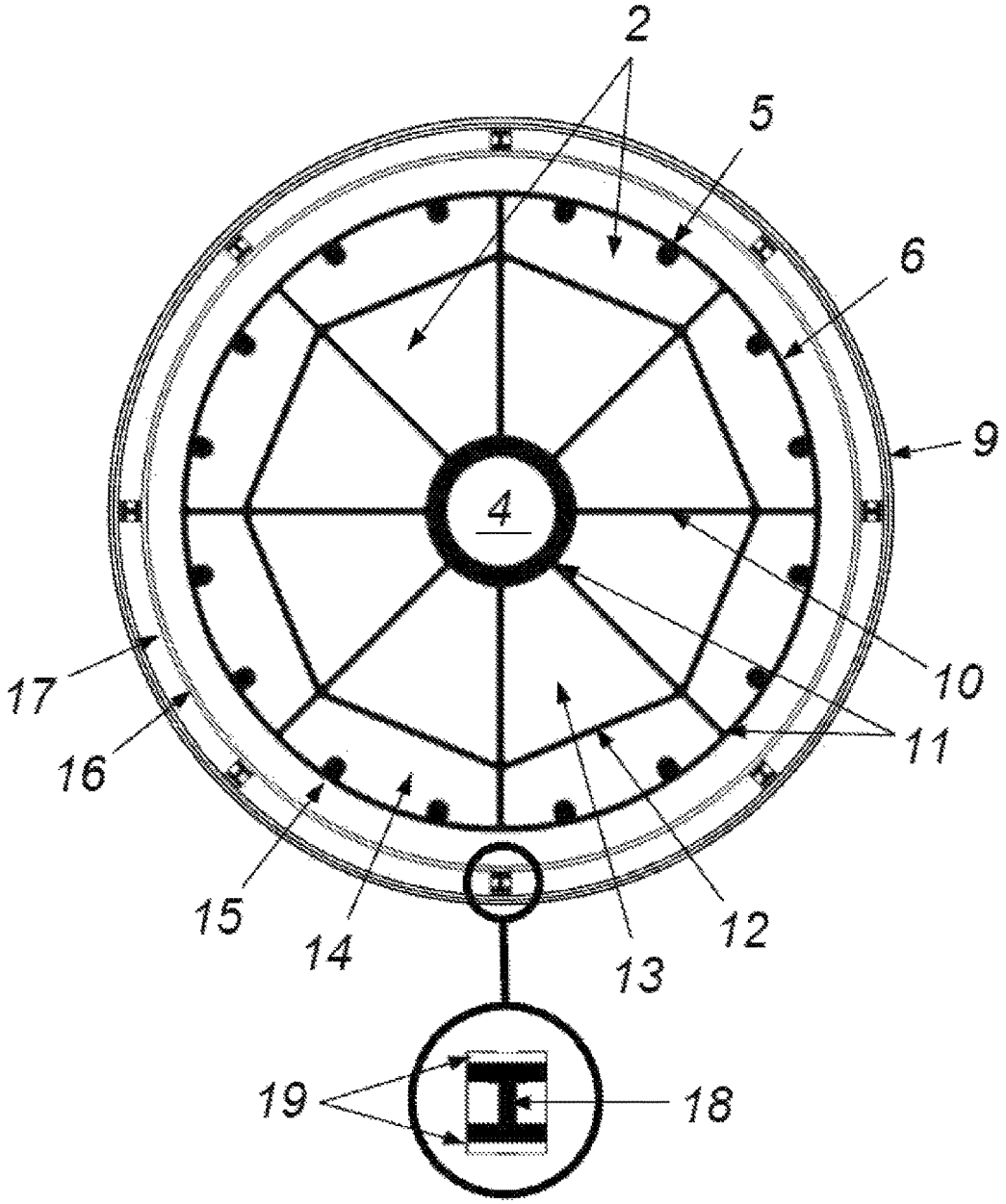
FIG. 2 illustrates a perspective view of the thermal reservoir with the water reservoir to the front.

The thermal storage compartment 2, as shown in FIG. 2, has a cross-section similar to a broad annulus with the inner ring bounded by the exterior face of the steam cylinder and the outer ring bounded by the inner face of the charging cylinder 6. Within this space lies the main thermal storage substance. The preferred design for the thermal storage compartment includes a triple purpose heat exchanger. Not only does the heat exchanger move heat from the thermal storage compartment 2 to create steam, but it also facilitates the charging process and provides the structural support to prevent collapse of the air evacuated compartments. A plurality of radial fins 10 comprised of rectangular sheets connecting the steam cylinder and the charging cylinder 6 and arranged in a spoke like manner extend along the entire length of each cylinder. Grooves 11 cut into or protruding from both cylinders enables each radial fin to slide in place and permanently maintain relative position. Similarly constituted bridge fins 12 connect adjacent radial fins 10 in the expanse between the cylinders. Bridge fins 12 lend additional support to the radial fins 10, can serve as a physical separator when a combination of thermal storage media is employed, and minimize the average distance between the mass of the relatively low thermal conducting thermal storage substance and the high thermal conducting material of the heat exchanger. Ideally, the heat exchanger, which is a combination of the radial 10 and bridge fins 12 and the charging cylinder 6 would be composed of a non-reactive material with very high thermal conductivity. Copper and nickel, in addition to the previously mentioned ceramics, are likely candidates for this purpose. To charge the thermal storage compartment 2, electrical heating elements 5 interface directly with the interior face of the charging cylinder 6. Each heating element 5 should run the length of the charging cylinder 6 and there should be one heating element 5 for each radial section formed by the radial fins 10.

The ideal thermal storage substance for powering vehicles is based on maximizing a family of crucial properties: heat capacity and thermal conductivity over a broad temperature range, density, melting or decomposition point, heat of fusion, thermal expansion, reactivity, toxicity, and cost. Lithium fluoride (LiF) is the outstanding candidate for the role of thermal storage substance. LiF has a high density of 2.64 g/cm$^3$ in the solid state with a melting point of 848.2° C. It maintains a very high heat capacity averaging 2.1 J/g·K before the melting point is reached. Although LiF has a very high heat of fusion (1044.4 J/g), upon melting, LiF experiences a 46% volumetric expansion and a drastic 4-fold reduction in thermal conductivity. Therefore, taking advantage of LiF's heat of fusion would necessitate a much larger thermal reservoir and add a substantial duration to the charge time. During discharge, i.e. operation, the molten state would create the anomalous result of far less available power at full charge than at half charge. Molten substances also pose an additional hazard in the event of a violent rupture. Maintaining the solid state, 400 kg LiF between the temperatures of 125-845 C stores approximately 605 MJ of thermal energy. This is the energy equivalent of 5 gallons of fully combusted gasoline.

Pursuit of the greater energy that comes with higher temperatures, while still avoiding the molten state, would require a substance with a high specific heat and high melting temperature. With the right combination of substances, higher temperatures may prove to be of little concern in certain applications. In such an instance, LiF could be replaced with magnesium oxide (MgO). 400 kg MgO between the temperatures 125-1525 C stores approximately 700 MJ of thermal energy.

The preferred embodiment of the thermal storage substance will be a combination of LiF and MgO. This permits greater thermal storage at cooler temperatures while mitigating the volume and thermal conductivity issues that arise from using LiF alone. Going up to the molten state, LiF could be partitioned from and yet surrounded by a layer of MgO with the LiF in the inner compartment 13 of the radial section formed by the bridge fins 12 and MgO in the outer compartment 14. The presence of MgO would enable much better thermal conductivity while LiF is in the molten state and MgO occupies less space. Combining 250 kg LiF and 150 kg MgO, between the temperatures of 125-860 C, stores about 785 MJ of thermal energy.

Even higher yields at even lower temperatures are possible if LiF is combined with lithium hydroxide (LiOH). This combination would take LiOH to the molten state and leave LiF solid in the outer compartment 14. Between 125-825 C, 400 kg of an equal mixture can yield about 890 MJ. Solid LiF would provide relatively rapid heat transfer while LiOH is molten and a relatively poor conductor. The colder the LiF compartment gets relative to the LiOH compartment, the greater the rate of heat transfer away from the LiOH. Keeping the LiOH in the inner compartment 13 of the bridge fins 12 and the LiF in the outer compartment 14 will compensate for the low conductivity of the molten LiOH by maximizing its surface area relative to volume. However, due to the very caustic nature of molten LiOH, it would likely be necessary to use ceramic materials exclusively for the structural and heat exchanging components of the thermal storage compartment 2.

The insulating compartment 3 serves to minimize heat loss. It extends from the outer face of the charging cylinder 6 to the outermost cylinder 9. Moderate levels of heat loss are acceptable, for instance, an average heat bleed of 50 W represents a weekly self-discharge rate of approximately 5% and some heat leakage will help maintain the water stored in the adjacent reservoir 8 in its liquid phase in the event of long duration subfreezing temperatures. Ultimately, the degree of insulation posses a trade off between minimizing heat loss and minimizing the weight, volume and cost of the insulation layer. Notably, the rate of heat leakage is not solely dependent on the robustness of the insulation layer but the degree of charge and the weather that determines the temperature differential between the interior and the environment.

Figure 3:
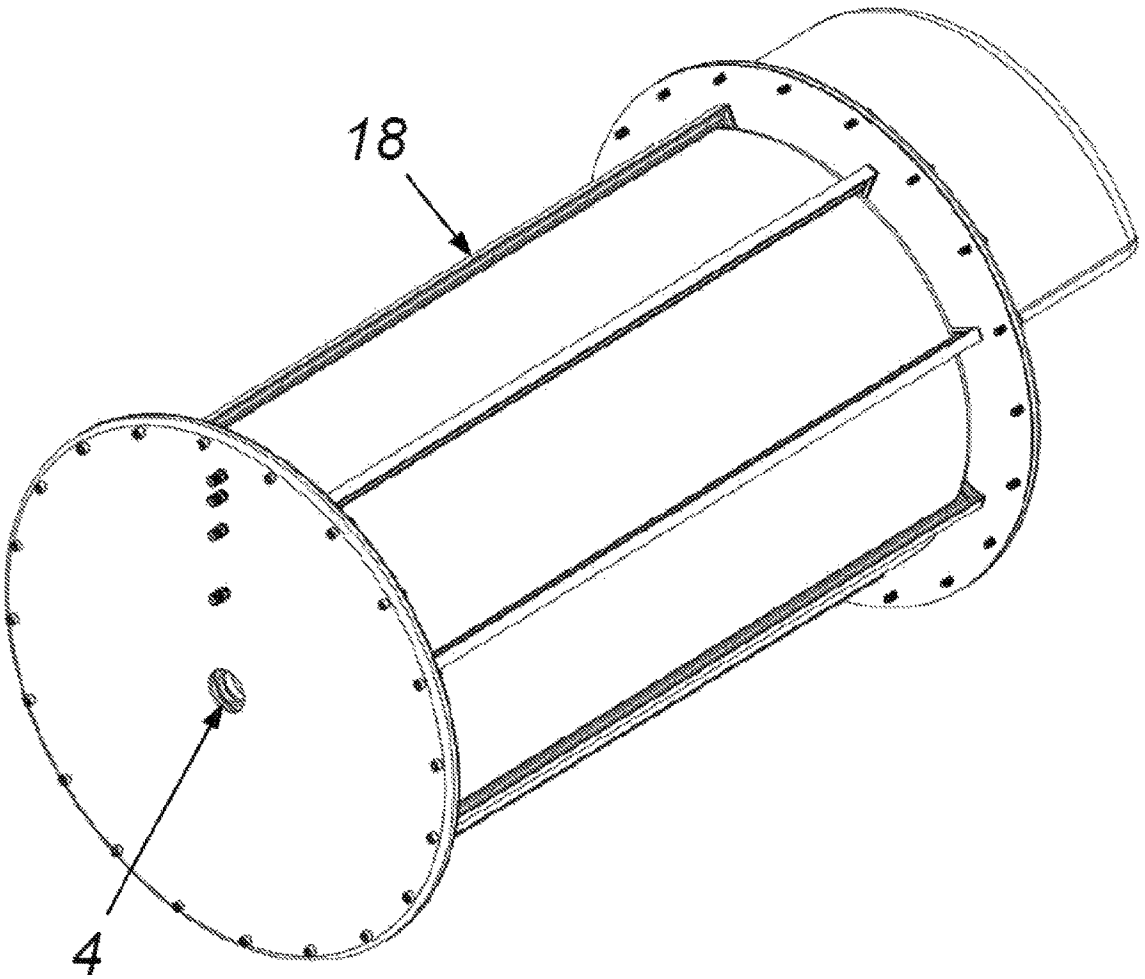
FIG. 3 illustrates a cross sectional view of the thermal reservoir.

The preferred embodiment of an insulation compartment 3, is made up of a layer of dried calcium silicate powder 15, followed by the jacket cylinder 16, followed by a vacuum layer 17, and finally, a steel layer that defines the outermost cylinder 9. The vacuum spacing between the jacket cylinder 16 surrounding the layer of calcium silicate 15 and the outermost cylinder 9 is maintained by small I-beam metallic supports 18 with a layer of asbestos footers 19 attached to each flange of the I-beam. The metallic supports 18 should possess low thermal conductivity and a high strength to weight ratio, preferably, Crucible 440C stainless steel. To minimize heat transfer via radiation, the vacuum facing sides of the two steel cylinders should possess special coatings. The inner face should possess a low emissive coating (aluminum foil) and the outer face should possess a high IR reflective coating (a polished surface). A preferred embodiment of the support 18 layout for the thermal reservoir is shown in FIG. 3.

Power output is ultimately determined by the degree to which steam is allowed to escape the steam cylinder. The valve responsible for the movement of steam to the engine is the steam release valve and will be connected to the throttle. The resultant steam generated by the thermal reservoir is the working fluid in the operation of a piston or turbine engine. The steam can be part of a closed cycle or simply vented to the atmosphere. When the engine is no longer in use, the steam conduit extending from the reservoir to the steam engine would be the source of significant heat loss even when water is no longer being actively pumped through the steam cylinder. This necessitates, after the engine is turned off, replacing the steam conduit with an insulation plug that seats into and forms a hermetic seal with the steam port 7. This plug should be equipped with a pressure release valve to permit the escape of any residual high pressure build up following the application of the plug. There must be a mechanism that toggles the position of these two parts and then seats them in place. While a specific toggle mechanism lies outside the scope of this patent, the mechanism must execute
the following series of events upon engine shutdown: (1) The steam conduit will retract from the steam port 7, (2) the steam conduit swings away from the steam port 7, while moving the insulation plug directly in front of it, and (3) the insulation plug extends into and is seated in the the steam port 7. The toggle mechanism should be electrically powered and draw its energy from the main vehicle battery.

Figure 4:
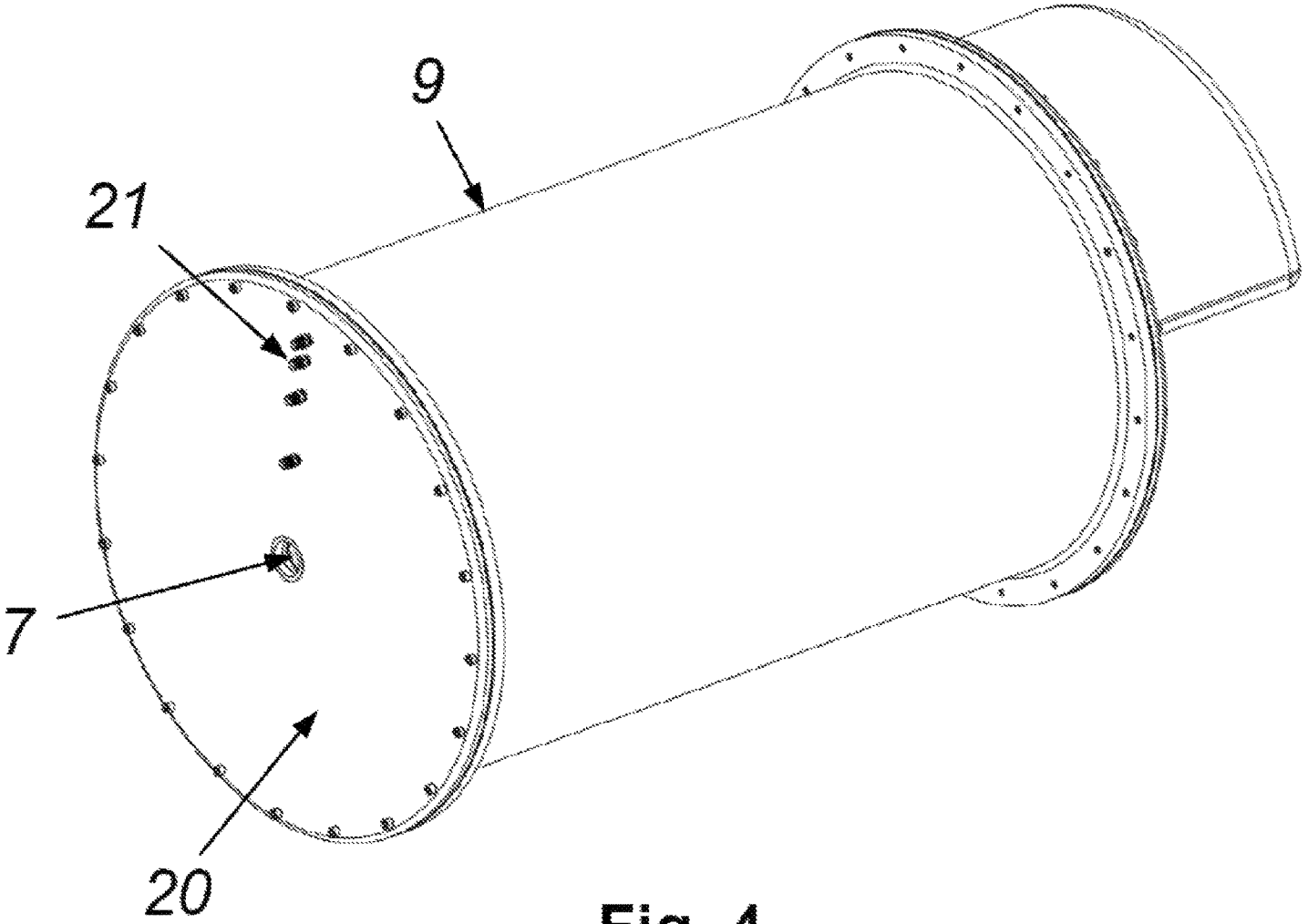
FIG. 4 illustrates a see through perspective view of the interface between the jacket cylinder and the outer cylinder.
Figure 5:
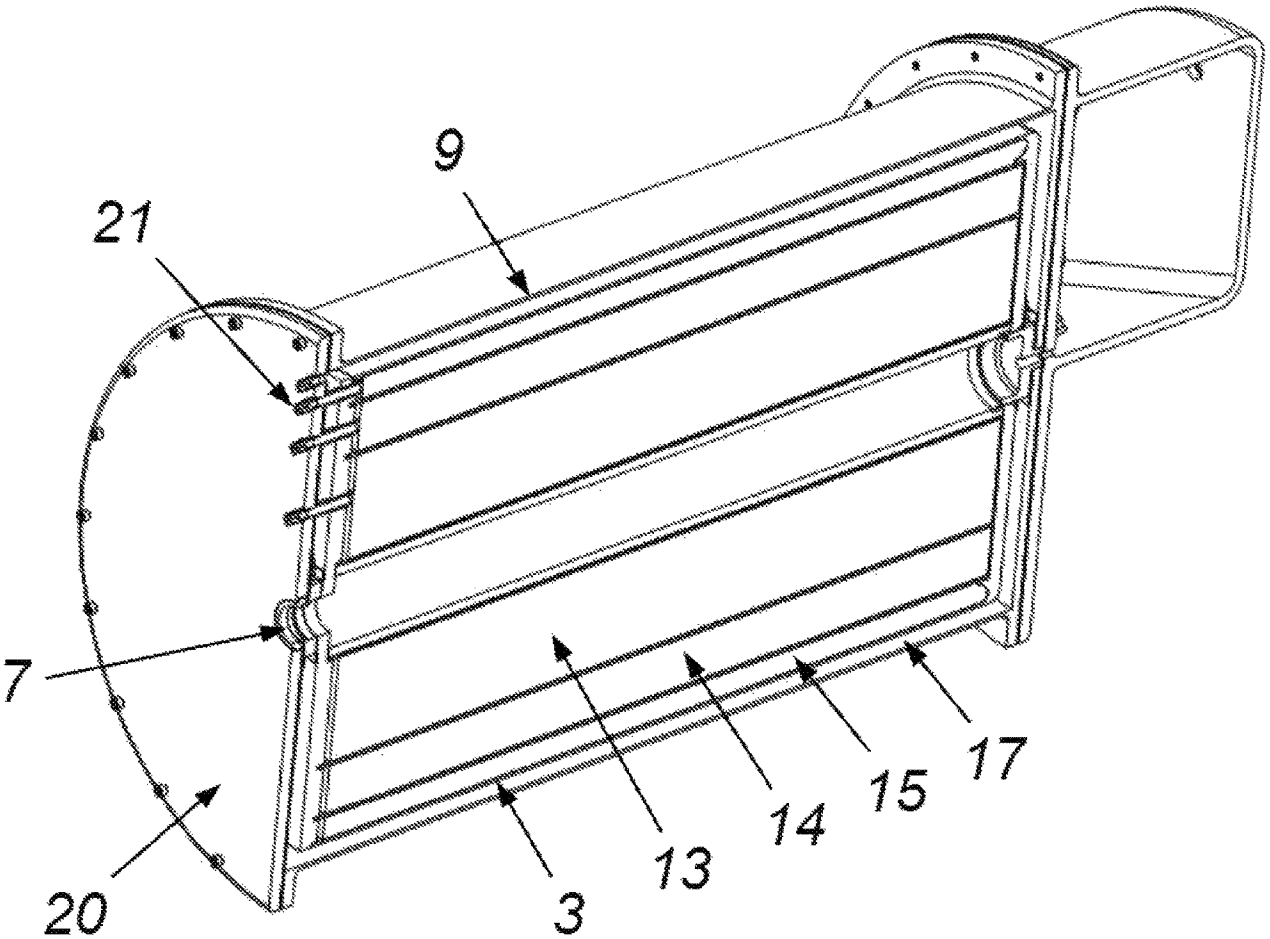
FIG. 5 illustrates a perspective view of the thermal reservoir with the steam port to the front.

Manufacture of the thermal reservoir involves nesting a series of cylinders that have one base side removed. FIGS. 4 and 5 illustrate how these cylinders are arranged and sealed. The base cap 20 is the final element added in the manufacture of the thermal reservoir and it serves to physically and hermetically isolate all the compartments and seal the outermost cylinder 9. To provide a means of removing the air left inside the separate compartments of the thermal reservoir, the base cap 20 possesses small diameter pressure release cylinders that pierce through it and connect four separate interior compartments with four one-way pressure release valves 21 that are flush with the outermost cylinder 9. The four evacuated compartments include the inner 13 and outer 14 compartments of the thermal storage compartment 2 and the calcium silicate 15 and vacuum 17 layers of the insulation compartment 3. Use of the one-way pressure release valves will enable evacuation when a vacuum line is attached to a valve and will also enable safe pressure release in the event some defect or damage of some kind enables internal pressure to rise.

Figure 6:
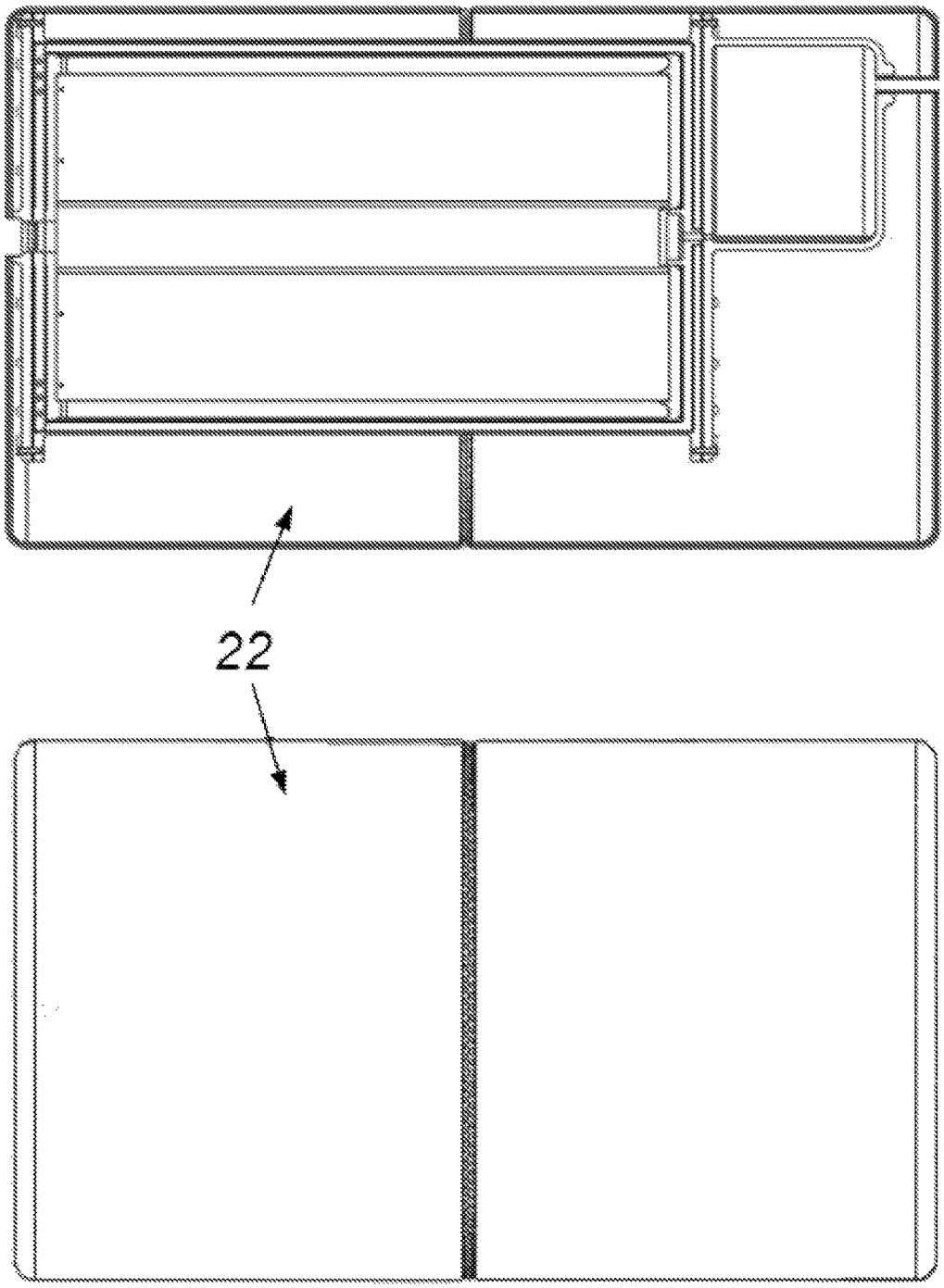
FIG. 6 illustrates the molten material retention bag covering the thermal reservoir.

If thermal storage substances are brought to the molten state for vehicular applications, it would be wise to contain any spillage in the event of a powerful collision. Toward that end, a temperature-resistant loose fitting bag 22, as shown in FIG. 6, should be draped over the thermal reservoir. Ideally, the bag would be bifurcated so that each half of the bag is designed to be pulled over just one end of the thermal reservoir with each half of the bag possessing holes just large enough to accommodate the specific conduits or wires emerging from that end. The two halves come together and attach near the middle of the cylinder with a zipper or other attachment means.

The invention claimed is:

1. A thermal reservoir that stores heat to generate steam for a piston or turbine engine and possesses a series of nested cylinders; the innermost of these cylinders is a steam cylinder for transferring heat to water for steam generation; the steam cylinder lies inside a charging cylinder; the charging cylinder adds electrically generated heat to a thermal storage substance that lies between the charging cylinder and the steam cylinder; the thermal storage substance is a physically separated combination of lithium fluoride and magnesium oxide; the outer face of the charging cylinder is surrounded by insulation; and this insulation is encased within the outermost cylinder.

2. A thermal reservoir that stores heat to generate steam for a piston or turbine engine and possesses a series of nested cylinders; the innermost of these cylinders is a steam cylinder for transferring heat to water for steam generation; the steam cylinder lies inside a charging cylinder; the charging cylinder adds electrically generated heat to a thermal storage substance that lies between the charging cylinder and the steam cylinder; the thermal storage substance is a physically separated combination of lithium fluoride and lithium hydroxide; the outer face of the charging cylinder is surrounded by insulation; and this insulation is encased within the outermost cylinder.

3. A thermal reservoir that stores heat to generate steam for a piston or turbine engine and possesses a series of nested cylinders; the innermost of these cylinders is a steam cylinder for transferring heat to water for steam generation; the steam cylinder lies inside a charging cylinder; the charging cylinder adds electrically generated heat to a thermal storage substance that lies between the charging cylinder and the steam cylinder; in addition to the thermal storage substance between the steam and charging cylinders, this compartment also contains a heat exchanger that connects the steam cylinder with the charging cylinder via a series of radial fins and these radial fins are further supported by bridge fins that connect adjacent radial fins; the outer face of the charging cylinder is surrounded by insulation; and this insulation is encased within the outermost cylinder.

4. A device as in claim 1, in which:

a. the insulation is comprised of a layer of calcium silicate encased within a jacket cylinder and outside the jacket cylinder is a layer of vacuum that extends to the outermost cylinder and this layer is supported by a plurality of steel I beams.

5. A device as in claim 1, in which:

a. the insulation is comprised of a layer of calcium silicate encased within a jacket cylinder and outside the jacket cylinder is a layer of vacuum that extends to the outermost cylinder and this layer is supported by a plurality of steel I beams; and b. the water used to produce steam is stored in a reservoir attached immediately adjacent to the outermost cylinder of the thermal reservoir.

6. A device as in claim 1, in which:

a. the insulation is comprised of a layer of calcium silicate encased within a jacket cylinder and outside the jacket cylinder is a layer of vacuum that extends to the outermost cylinder and this layer is supported by a plurality of steel I beams;

b. the water used to produce steam is stored in a reservoir attached immediately adjacent to the outermost cylinder of the thermal reservoir; and c. the thermal reservoir is enclosed in a molten material retention bag that is bifurcated so that each half of the bag is designed to be pulled over just one end of the thermal reservoir with each half of the bag possessing holes just large enough to accommodate the specific conduits or wires emerging from that end and these two halves come together and are attached at or near the middle of the cylinder.

7. A device as in claim 1, in which:

a. the insulation is comprised of a layer of calcium silicate encased within a jacket cylinder and outside the jacket cylinder is a layer of vacuum that extends to the outermost cylinder and this layer is supported by a plurality of steel I beams;

b. the water used to produce steam is stored in a reservoir attached immediately adjacent to the outermost cylinder of the thermal reservoir; and c. the thermal reservoir is enclosed in a molten material retention bag that is bifurcated so that each half of the bag is designed to be pulled over just one end of the thermal reservoir with each half of the bag possessing holes just large enough to accommodate the specific conduits or wires emerging from that end and these two halves come together and are attached at or near the middle of the cylinder; and d. a plurality of one-way pressure release valves is installed into the cap base and each valve communicates with one of the interior compartments requiring evacuation of gases during the manufacturing process: the thermal storage compartments and the insulation compartment.

8. A device as in claim 2, in which:

a. the insulation is comprised of a layer of calcium silicate encased within a jacket cylinder and outside the jacket cylinder is a layer of vacuum that extends to the outermost cylinder and this layer is supported by a plurality of steel I beams.

9. A device as in claim 2, in which:

a. the insulation is comprised of a layer of calcium silicate encased within a jacket cylinder and outside the jacket cylinder is a layer of vacuum that extends to the outermost cylinder and this layer is supported by a plurality of steel I beams; and b. the water used to produce steam is stored in a reservoir attached immediately adjacent to the outermost cylinder of the thermal reservoir.

10. A device as in claim 2, in which:

a. the insulation is comprised of a layer of calcium silicate encased within a jacket cylinder and outside the jacket cylinder is a layer of vacuum that extends to the outermost cylinder and this layer is supported by a plurality of steel I beams;

b. the water used to produce steam is stored in a reservoir attached immediately adjacent to the outermost cylinder of the thermal reservoir; and c. the thermal reservoir is enclosed in a molten material retention bag that is bifurcated so that each half of the bag is designed to be pulled over just one end of the thermal reservoir with each half of the bag possessing holes just large enough to accommodate the specific conduits or wires emerging from that end and these two halves come together and are attached at or near the middle of the cylinder.

11. A device as in claim 2, in which:

a. the insulation is comprised of a layer of calcium silicate encased within a jacket cylinder and outside the jacket cylinder is a layer of vacuum that extends to the outermost cylinder and this layer is supported by a plurality of steel I beams;

b. the water used to produce steam is stored in a reservoir attached immediately adjacent to the outermost cylinder of the thermal reservoir; and c. the thermal reservoir is enclosed in a molten material retention bag that is bifurcated so that each half of the bag is designed to be pulled over just one end of the thermal reservoir with each half of the bag possessing holes just large enough to accommodate the specific conduits or wires emerging from that end and these two halves come together and are attached at or near the middle of the cylinder; and d. a plurality of one-way pressure release valves is installed into the cap base and each valve communicates with one of the interior compartments requiring evacuation of gases during the manufacturing process: the thermal storage compartments and the insulation compartment.

12. A device as in claim 3, in which:

a. the insulation is comprised of a layer of calcium silicate encased within a jacket cylinder and outside the jacket cylinder is a layer of vacuum that extends to the outermost cylinder and this layer is supported by a plurality of steel I beams.

13. A device as in claim 3, in which:

a. the insulation is comprised of a layer of calcium silicate encased within a jacket cylinder and outside the jacket cylinder is a layer of vacuum that extends to the outermost cylinder and this layer is supported by a plurality of steel I beams; and b. the water used to produce steam is stored in a reservoir attached immediately adjacent to the outermost cylinder of the thermal reservoir.

14. A device as in claim 3, in which:

a. the insulation is comprised of a layer of calcium silicate encased within a jacket cylinder and outside the jacket cylinder is a layer of vacuum that extends to the outermost cylinder and this layer is supported by a plurality of steel I beams;

b. the water used to produce steam is stored in a reservoir attached immediately adjacent to the outermost cylinder of the thermal reservoir; and c. the thermal reservoir is enclosed in a molten material retention bag that is bifurcated so that each half of the bag is designed to be pulled over just one end of the thermal reservoir with each half of the bag possessing holes just large enough to accommodate the specific conduits or wires emerging from that end and these two halves come together and are attached at or near the middle of the cylinder.

15. A device as in claim 3, in which:

a. the insulation is comprised of a layer of calcium silicate encased within a jacket cylinder and outside the jacket cylinder is a layer of vacuum that extends to the outermost cylinder and this layer is supported by a plurality of steel I beams;

b. the water used to produce steam is stored in a reservoir attached immediately adjacent to the outermost cylinder of the thermal reservoir; and c. the thermal reservoir is enclosed in a molten material retention bag that is bifurcated so that each half of the bag is designed to be pulled over just one end of the thermal reservoir with each half of the bag possessing holes just large enough to accommodate the specific conduits or wires emerging from that end and these two halves come together and are attached at or near the middle of the cylinder; and d. a plurality of one-way pressure release valves is installed into the cap base and each valve communicates with one of the interior compartments requiring evacuation of gases during the manufacturing process: the thermal storage compartments and the insulation compartment.

* * * * *